US006832587B2

(12) United States Patent
Wampula et al.

(10) Patent No.: US 6,832,587 B2
(45) Date of Patent: Dec. 21, 2004

(54) PLASTIC VALVE COVER WITH INTEGRATED METAL

(75) Inventors: Dipl. -Ing Torsten Wampula, Ulm (DE); Ralf Göttel, Neu-Ulm (DE); Josef Ludwig, Niederstotzingen (DE)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/352,702

(22) Filed: Jan. 28, 2003

(65) Prior Publication Data

US 2004/0144349 A1 Jul. 29, 2004

(51) Int. Cl.[7] ..... F01M 9/10
(52) U.S. Cl. ..... 123/90.38; 123/195 C
(58) Field of Search ..... 384/439, 276; 123/90.38, 90.33, 90.34, 195 C

(56) References Cited

U.S. PATENT DOCUMENTS 4,358,086 A * 11/1982 Hiltebrand ..... 251/306
5,383,246 A * 1/1995 Hagen ..... 15/246
5,492,086 A * 2/1996 Kuhns ..... 123/90.38
5,575,256 A * 11/1996 Peters et al. ..... 123/337
5,601,680 A * 2/1997 Kuszaj et al. ..... 156/242
5,966,814 A * 10/1999 Lin ..... 30/123
6,241,493 B1 * 6/2001 Turner ..... 418/1
6,247,436 B1 * 6/2001 Lancefield et al. ..... 123/90.38
6,273,119 B1 * 8/2001 Foster et al. ..... 137/15.25

FOREIGN PATENT DOCUMENTS

| | | |
|---|---|---|
| DE | 2948572 | 6/1980 |
| DE | 3512713 A1 | 10/1986 |
| DE | 19833199 A1 | 1/2000 |
| DE | 10034329 C2 | 1/2002 |
| DE | 10034329 A1 | 1/2002 |

* cited by examiner

*Primary Examiner*—Thomas Denion
*Assistant Examiner*—Zelalem Eshete
(74) *Attorney, Agent, or Firm*—Rader, Fishman & Grauer PLLC

(57) ABSTRACT

The invention pertains to a valve cover for internal combustion engines with at least one overhead camshaft, wherein bearings for the camshaft(s) are embedded in a polymeric plastic material constituting the valve cover.

20 Claims, 5 Drawing Sheets

PLASTIC VALVE COVER WITH INTEGRATED METAL

BACKGROUND OF THE INVENTION

1. Field of the Invention

The invention pertains to a valve cover for internal combustion engines in which at least one overhead camshaft is present.

2. Description of the Related Art

Valve covers for internal combustion engines, which are placed on top of an engine block and fastened there, are generally made of pressure-cast metal or shaped sheet metal. The seating for the camshafts can be at least partially formed in the process, with the actual bearings either having to be installed later or mechanically reworked.

Moreover, it possible with pressure-casting of metal to produce any arbitrary shape desired by designers, and the seating surfaces of metal covers thus produced must also be subjected to further machining.

An additional drawback of valve covers produced this way is their relatively high mass.

Valve covers produced by the metal pressure-casting method and also valve covers obtained by shaping processes achieve sound-deadening only to a limited extent and in particular solid-borne sound is easily received and shows up as an elevated noise level.

For valve covers produced by the metal pressure-casting method, it is not possible for arbitrary metals, often particularly suitable, to be used for the bearings of the camshafts.

It is therefore the problem of the invention to provide a valve cover that achieves greater design freedom, a reduced mass and improved acoustic behavior in comparison to conventional solutions.

SUMMARY OF THE INVENTION

This problem is solved according to the invention by a valve cover according to claim 1. Advantageous configurations and refinements of the invention can be achieved with the characteristics cited in the subordinate claims.

The valve cover of the invention for internal combustion engines, usually to be used in motor vehicles, is constructed such that the bearings for the one or more camshafts are embedded in a plastic material forming the valve cover.

Suitable plastic materials, which are sufficiently temperature-resistant, have resistance to attack by fuels and lubricants and achieve a sufficient strength, are well known.

The valve cover according to the invention can be produced with a high degree of design freedom by the plastic injection molding method, wherein the bearings for the camshaft or multiple camshafts are molded in at the same time and sufficiently good positioning accuracy for the camshaft bearings can be achieved with no additional effort. Since the temperatures occurring during the injection-molding of plastics are not critical, arbitrary metal bearing materials can be molded in, so that optimal bearing matching of bearings to camshaft can be achieved.

The bearings for the camshaft can be inserted into the injection mold as semifinished products and no further mechanical machining of the bearing surfaces is necessary.

The bearings for the camshafts can be constructed as bearing blocks.

To increase the stability of the bearing cover, consisting essentially of plastic material along with the appropriate bearings for the camshafts, can be increased [sic] by an additional support structure preferably consisting of metal, which is likewise embedded in the plastic material.

There are several possibilities that can be considered for the formation of such a support structure and can be used individually or in combination with one another.

Thus, such a support structure can be formed from longitudinal and/or transverse ribs which connect the bearings, even in a curved shape. The necessary strength and stability of such a support structure can be easily obtained by calculation using known methods, so that the necessary strength and stability and the increase in mass resulting from the support structure can be optimized. Thus, such a support structure can be constructed similarly to half-timbered construction [in houses].

It is also advantageous to integrate other elements necessary for valve covers into the structure of such a support structure as well. Thus, passage holes for fastening elements are necessary in any case for fastening valve covers to engine blocks to internal combustion engines; for the sake of strength in the case of a valve cover consisting essentially of plastic material, these can be imbedded and molded-in sleeve-shaped metal elements. These sleeve-shaped elements are oriented vertically and ensure a high degree of stability and strength when they are joined to other elements of the support structure and/or the bearings, so that they constitute particularly well-suited buttresses for the forces and torques that are operative.

Since the bearing points must be lubricated, the oil supply system, via channels to the respective bearing points of the camshaft(s), can also be integrated into the valve cover and corresponding oil supply channels, likewise preferably consisting of appropriately bent tubular structures, can be embedded in the plastic material and molded in during the injection-molding process. There is therefore also the possibility of integrating oil supply channels into the support structure.

There need not be any elaborate post-machining of the valve cover after removal from the injection-molding tool, apart from the removal of projecting residues of plastic and it represents a semifinished product, into which one or more camshaft(s) can be easily inserted and fixed in place.

To this end, it is possible for an opening, through which the respective camshaft can be inserted, to be present on one end face, as viewed in the longitudinal axial direction of the valve cover. The inside diameters of the bearings decrease successively starting from the insertion opening, the outer diameters of the bearing points on the camshaft decreasing to the same degree for the individual bearings arranged in succession. After the insertion of the camshaft(s) into the bearings, the insertion opening can be closed off with a metal disk affixed to the valve cover. Such a metal disk can, for instance, be fastened to the valve cover with a conventional screw closure, a corresponding threaded fitting likewise being embedded and molded into the plastic material. The metal disk can consist of a suitable metal and be correspondingly contoured so that it can simultaneously take on the functions of an axial bearing for the respective camshaft.

A continuous groove-shaped gasket receptacle arranged on the outer rim can be present on the bottom side of the valve cover, which rests on the upper end face of the engine block; a suitable gasket is inserted into [said receptacle] and positively retained there.

Such a groove-like gasket receptacle can also consist of a metal and then be partially embedded into the plastic material, so that additionally the strength and stability, as well as the accuracy of fit, are enhanced. It goes without saying that there is also the possibility of integrating such a metal gasket receptacle into the remaining support structure.

Taking into account the noise emission that occurs, the wall thickness of the plastic material being used can be of an appropriately large size at the different positions, such a design also being undertaken with consideration given to the locally differing strength requirements.

Both the strength and the acoustic behavior of the valve cover according to the invention can be increased and improved by the addition of fibers to the plastic material used. Thus, glass, plastic or carbon fibers can be employed and added to the plastic material injected into the injection molding tool, depending on the requirements.

Particularly for the small-series production of valve covers according to the invention, an appropriate fiber composite in mat or woven form can be used for reinforcement, in which case the valve covers can be manufactures with a laminate process.

In all cases, additional elements, such as a collapsible opening for adding motor oil, which are necessary for valve covers in any case, can be obtained in a single work step during the injection molding.

Furthermore, it is easily possible when using injection molding to form, on the outside of a valve cover according to the invention, receptacles for additional elements such as covers for lines or hoses which then have corresponding projections that can be pressed or screwed into the receptacles on the outside of the valve cover and retained there positively or nonpositively. Thus, the cover for a toothed belt can be correspondingly fastened to a valve cover.

The invention will be explained below in further detail on the basis of embodiments.

DESCRIPTION OF THE PREFERRED EMBODIMENT

Figure 1:
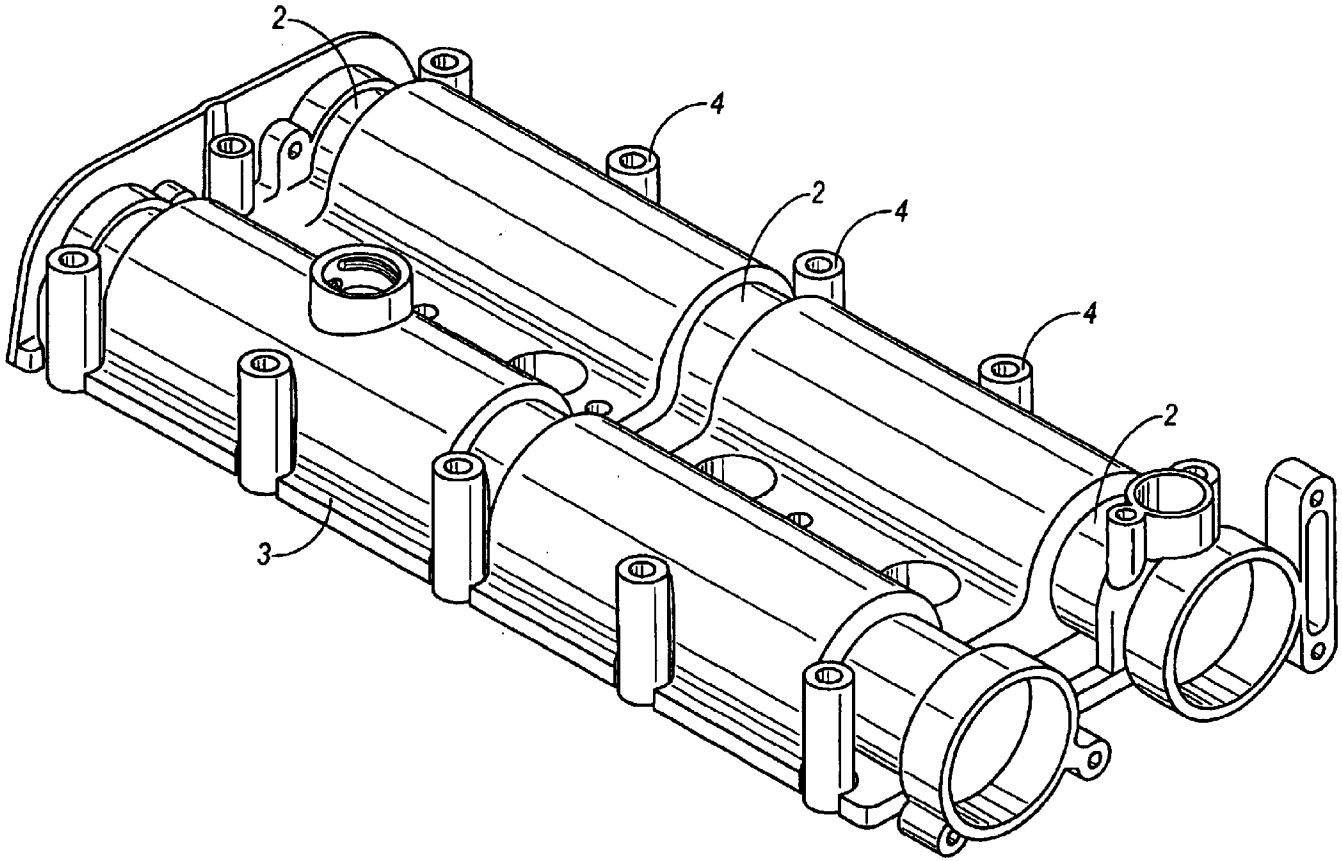
FIG. 1 is a perspective view of individual elements embedded in a plastic material, in an example of a valve cover according to the invention with two camshafts.

In the perspective representation in FIG. 1, the arrangement of various elements for an example of a valve cover 1 according to the invention is illustrated, with two camshafts oriented in parallel and arranged alongside one another. The elements, consisting essentially of identical metals, but also of different ones, are also surrounded at least in part by plastic material and embedded in it so that, along with their actual functionality, these elements can also fulfill a support function for the plastic material and thus also for valve cover 1.

The position and arrangement of bearings 2 in the plastic material, not shown, along an axis of the respective camshafts is clearly recognizable; in the example shown here, a triple-bearing camshaft can be used.

Additionally shown are metal sleeve-shaped elements 4, through which the fastening elements for valve cover 1 can be guided to or from a motor block of an internal combustion engine.

Also recognizable are other elements without reference numerals which, in addition to increasing strength, are also used for supplying motor oil to and removing it from bearings 2 or for filling the oil pan.

Figure 2:
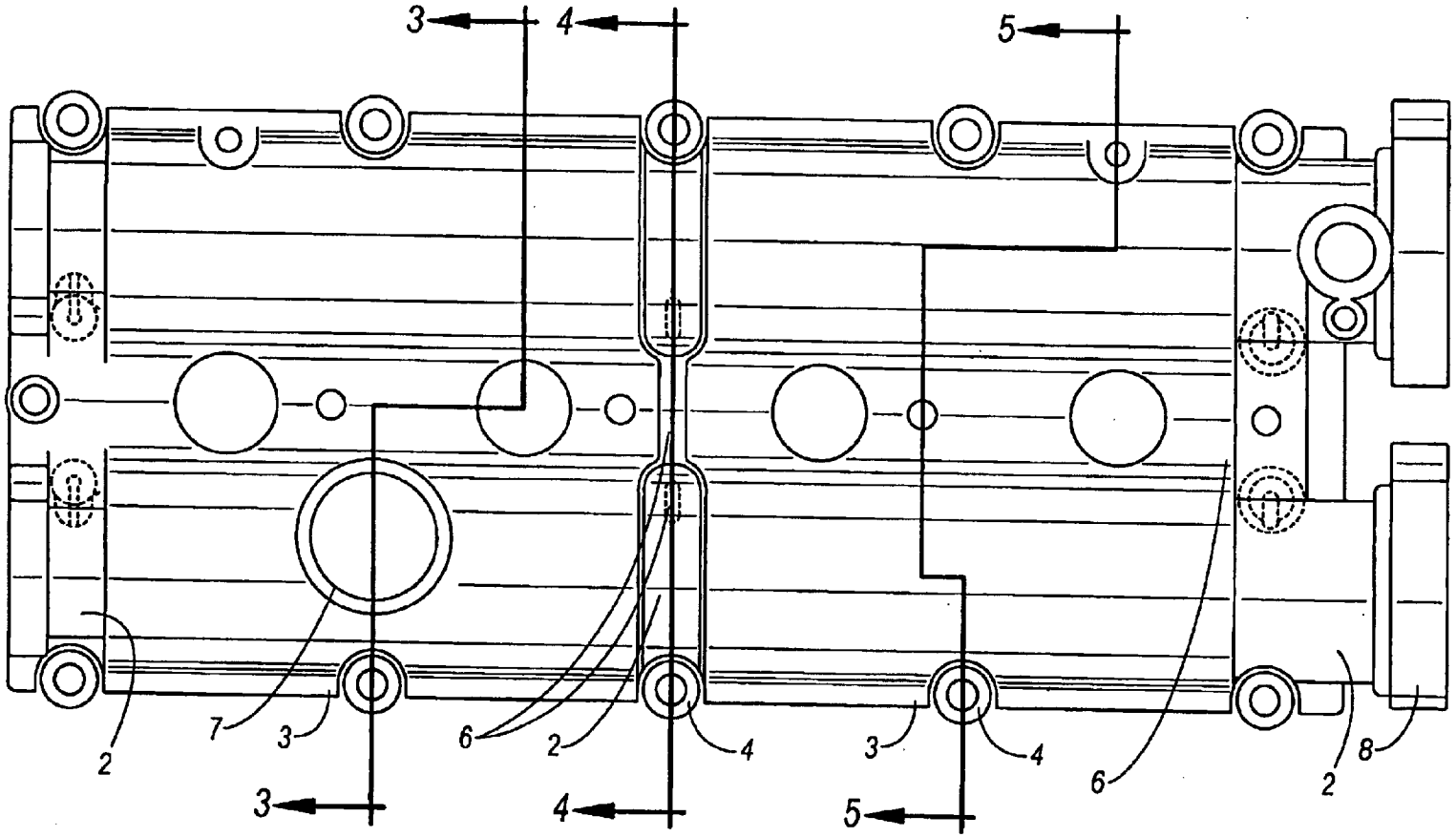
FIG. 2 is a section view onto a valve cover according to FIG. 1.

The regular arrangement of passage holes 4 for the fastening element of valve cover 1 is recognizable from the sectional representation from above of an example of a valve cover 1 according to the invention shown in FIG. 2. Also recognizable are longitudinal strips 11 that connect sleeve-shaped elements 4 and may be part of the support structure consisting in essence of metal elements.

Oil supply channels 6, which are likewise part of the support structure of valve cover 1, at least in part, are led to each of the bearings 2 for the two camshafts.

The filling opening 7 for motor oil, provided with inside threading, is likewise drawn in.

A metal disk 5, with which the camshafts installed in valve cover 1 are axially retained, is fastened to the left end face here as an axial bearing one end of each of the two camshafts.

Gearwheels 8, by means of which the two camshafts can be driven, are flanged onto the other end face of valve cover 1 and accordingly also onto the other end of the respective camshaft.

A groove-like gasket receptacle 10 of a metal, which can also fulfill a support function like that of longitudinal strips 11 to increase stability and strength in addition to its actual sealing function, is present in FIG. 1 on the bottom face.

Figure 3:
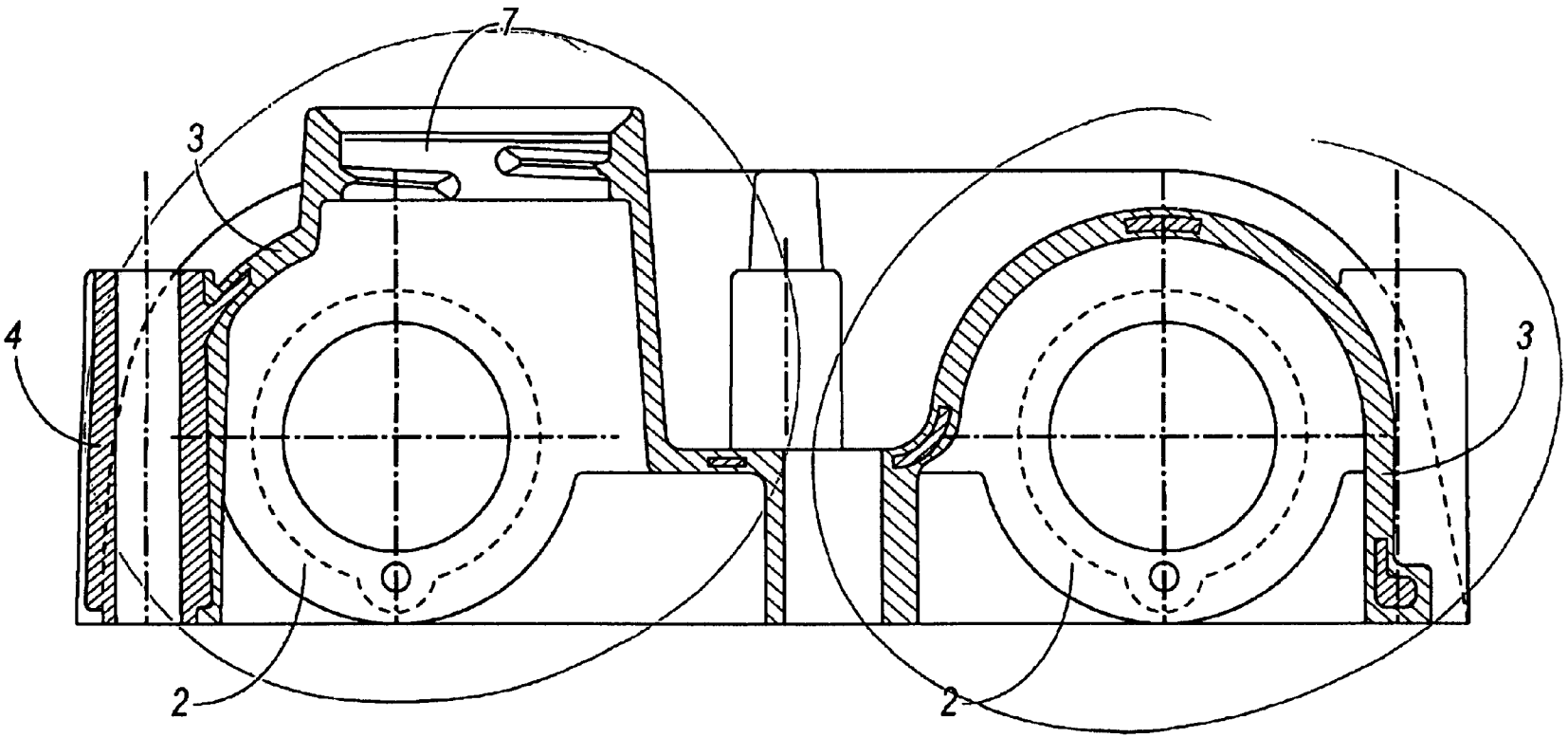
FIG. 3 is a section view along line A—A from FIG. 2.

Possibilities for integrating elements necessary in any case into a support structure are recognizable in the section along line A—A shown in FIG. 3. Thus, for instance, the sleeve-shaped metal element 4 is connected to a part of motor oil filling opening 7, likewise consisting of metal, which is thus a component of support structure 3. A molded-in covering for a bearing 2 of the camshaft, likewise a component of support structure 3, is additionally illustrated. A rib-shaped reinforcement is drawn in at lower right edge of the cover.

Figure 4:
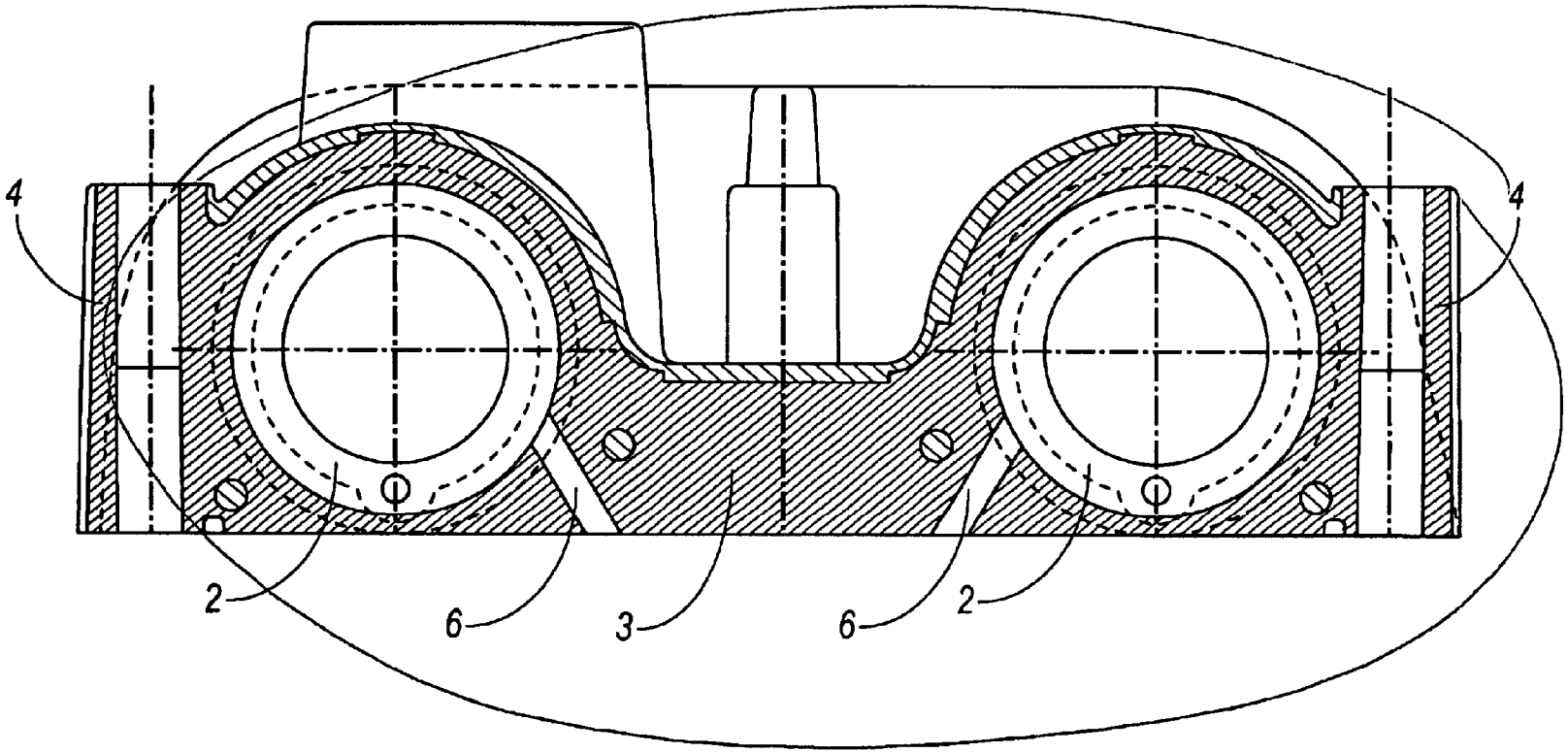
FIG. 4 is a section view along line B—B from FIG. 2.

In the sectional representation along the line C—C [sic; B—B] in FIG. 4, a double bearing block for two bearings 2 of the adjacent camshafts is shown; it too represents a part of support structure 3 with respective sleeve-shaped elements 4 for passing fastening elements of valve cover 1 arranged on the outside. Parts of oil supply channels 6 are led through the bearing blocks.

Figure 5:
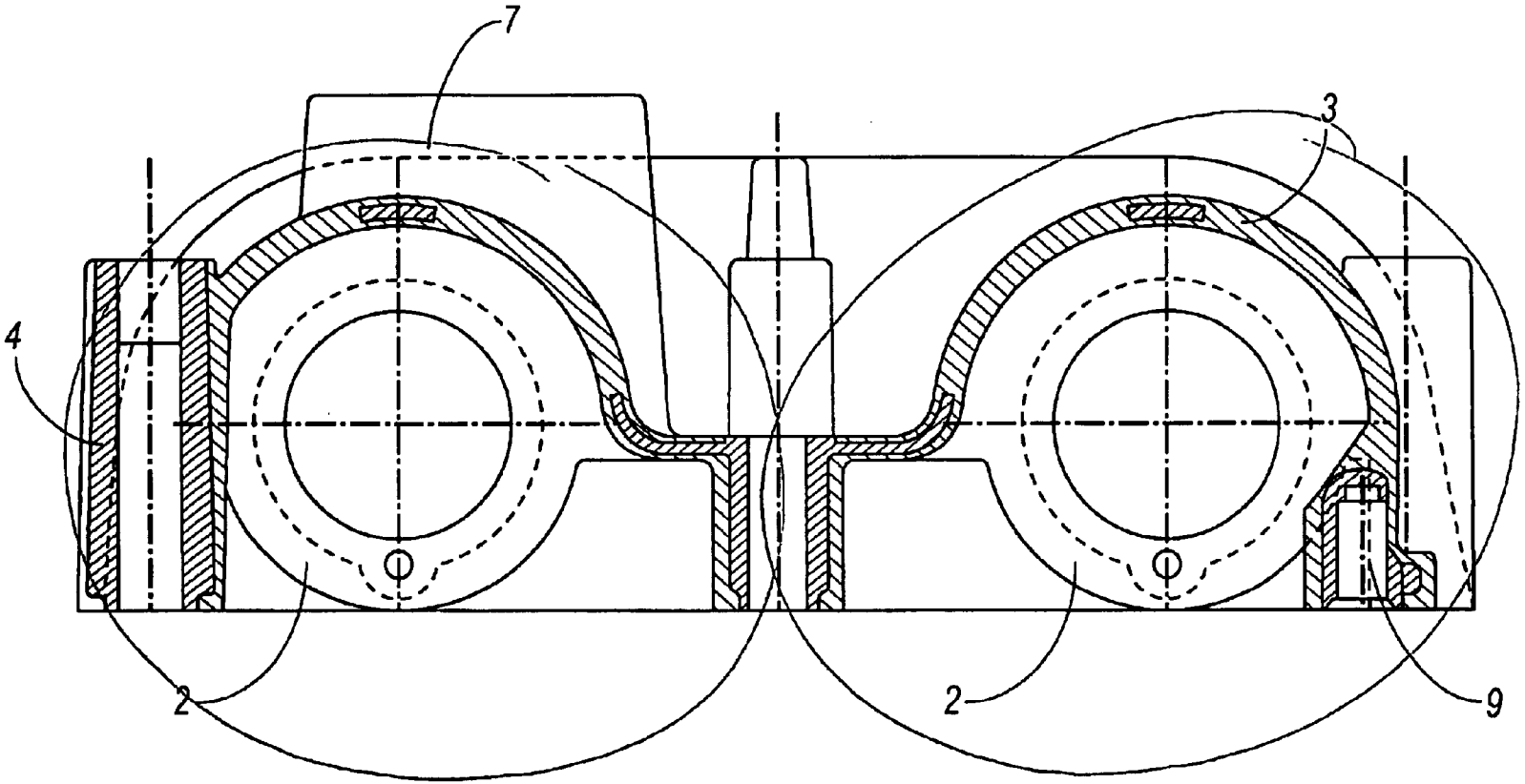
FIG. 5 is a section view along line C—C from FIG. 2.

A sleeve-shaped element 4 that is joined to a part of support structure 3 around bearings 2 and likewise terminates centrally in a metal-reinforced passage for fastening elements is shown in the section along lines C—C shown in FIG. 5.

A receptacle 9 for dimensionally exact positioning of valve cap 1 according to the invention is shown at the right lower rim; a centering pin can be introduced therein when valve cover 1 is placed on the upper end face of an engine block, and subsequently the fastening elements for valve cover 1 can be tightened in a dimensionally accurate position. It goes without saying that receptacle 9 for centering pins can also consist of metal and be integrated into support structure 3.

While the invention has been specifically described in connection with certain specific embodiments thereof, it is to be understood that this is by way of illustration and not of limitation, and the scope of the appended claims should be construed as broadly as the prior art will permit.

What is claimed is:

1. A valve cover for an internal combustion engine with an overhead camshaft made of polymeric plastic material and having at least one camshaft bearing embedded therein, and having a metal support structure embedded in the polymeric plastic material for providing additional support to said valve cover;

wherein said valve cover comprises a continuous groove-shaped gasket receptacle and a rim on a bottom side of said valve cover, and wherein said continuous groove-shaped gasket receptacle is positioned on said rim;

wherein said continuous groove-shaped gasket receptacle is made of a metal material and is partly embedded in the polymeric plastic material; and wherein said continuous groove-shaped gasket receptacle comprises at least one positive attachment and at least one nonpositive attachment, wherein said positive and nonpositive attachments are formed on an exterior of said valve cover, and wherein said exterior of said valve cover is embedded in the polymeric plastic material.

2. A valve cover according to claim 1, wherein said at least one camshaft bearing comprises a bearing block.

3. A valve cover according to claim 1, wherein said metal support structure comprises at least one longitudinally extending rib and at least one transversely extending rib, and wherein said longitudinally extending rib and said transversely extending rib are arranged between said at least one camshaft bearing, and wherein said at least one camshaft bearing connects said longitudinally extending rib to said transversely extending rib.

4. A valve cover according to claim 1, wherein said valve cover further comprises a sleeve-shaped metal element for fastening said valve cover to a block of the internal combustion engine.

5. A valve cover according to claim 4, wherein said sleeve-shaped metal element is part of said metal support structure.

6. A valve cover according to claim 1, wherein said valve cover comprises an oil supply channel embedded in the polymeric plastic material.

7. A valve cover according to claim 6, wherein said oil apply channel is a component of said metal support structure.

8. A valve cover according to claim 3, wherein said longitudinally extending rib and said transversely extending rib are perpendicular.

9. A valve cover according to claim 1, wherein said at least one camshaft bearing comprises an inner diameter, and wherein said inner diameter of said at least one camshaft bearing is enlarged from said valve cover.

10. A valve cover according to claim 1, wherein said valve cover comprises a metal disk fastened to one end of said valve cover, and wherein said metal disk acts as an axial bearing for said at least one camshaft bearing.

11. A valve cover according to claim 1, wherein said continuous groove-shaped gasket receptacle is a component of the metal support structure.

12. A valve cover according to claim 1, wherein the polymeric plastic material includes fibers or a fiber composite.

13. A valve cover for an internal combustion engine with an overhead camshaft made of a polymeric plastic material and having at least one camshaft bearing embedded therein, and having a metal support structure embedded in said polymeric plastic material for providing additional support to said valve cover;

wherein said valve cover comprises a continuous groove-shaped gasket receptacle and a rim on a bottom side of said valve cover, and wherein said continuous groove-shaped gasket receptacle is positioned on said rim; and wherein said continuous groove-shaped gasket receptacle comprises at least one positive attachment and at least one nonpositive attachment, wherein said positive and nonpositive attachments are formed on an exterior of said valve cover, and wherein said exterior of said valve cover is embedded in said polymeric plastic material.

14. A valve cover according to claim 13, wherein said at least one camshaft bearing comprises a bearing block.

15. A valve cover according to claim 13, wherein said metal support structure comprises at least one longitudinally extending rib and at least one transversely extending rib, and wherein said longitudinally extending rib and said transversely extending rib are arranged between said at least one camshaft bearing, and wherein said at least one camshaft bearing connects said longitudinally extending rib to said transversely extending rib.

16. A valve cover according to claim 13, wherein said valve cover further comprises a sleeve-shaped metal element for fastening said valve cover to a block of the internal combustion engine.

17. A valve cover according to claim 16, wherein said sleeve-shaped metal clement is part of said metal support structure.

18. A valve cover according to claim 13, wherein said valve cover comprises an oil supply channel embedded in said polymeric plastic material.

19. A valve cover according to claim 13, wherein said at least one camshaft bearing comprises an inner diameter, and wherein said inner diameter of said at least one camshaft bearing is enlarged from said valve cover.

20. A valve cover according to claim 13, wherein said valve cover comprises a metal disk fastened to one end of said valve cover, and wherein said metal disk acts as an axial bearing for said at least one camshaft bearing.

* * * * *